US006740020B2

(12) United States Patent
Horibe et al.

(10) Patent No.: US 6,740,020 B2
(45) Date of Patent: May 25, 2004

(54) PLASTIC BAG MAKING APPARATUS

(75) Inventors: Mitsuhiko Horibe, Osaka (JP); Yoshiaki Fujito, Kyoto (JP); Toshinori Ueda, Osaka (JP)

(73) Assignee: Totani Corporation, Kyoto (JP)

( * ) Notice: Subject to any disclaimer, the term of this patent is extended or adjusted under 35 U.S.C. 154(b) by 0 days.

(21) Appl. No.: 10/424,097

(22) Filed: Apr. 28, 2003

(65) Prior Publication Data

US 2003/0203798 A1 Oct. 30, 2003

(30) Foreign Application Priority Data

Apr. 26, 2002 (JP) ..... 2002-126360

(51) Int. Cl.[7] ..... B31B 1/90

(52) U.S. Cl. ..... 493/218; 493/193; 493/198; 493/231; 493/250

(58) Field of Search ..... 493/186, 193, 493/194, 198, 218, 231, 250, 251

(56) References Cited

U.S. PATENT DOCUMENTS 2,961,930 A * 11/1960 Wamsley et al. ..... 493/439
3,114,298 A * 12/1963 Boone ..... 493/203
3,796,140 A * 3/1974 Adams et al. ..... 493/244
3,988,970 A * 11/1976 Hanson et al. ..... 493/194
4,252,052 A * 2/1981 Meyers et al. ..... 493/134
4,280,313 A * 7/1981 Akkala et al. ..... 53/175
4,522,618 A * 6/1985 Stannard ..... 493/143
4,548,826 A * 10/1985 Watkins ..... 426/394
4,892,511 A * 1/1990 Luciano et al. ..... 493/194

* cited by examiner

*Primary Examiner*—Eugene Kim
*Assistant Examiner*—Christopher R Harmon
(74) *Attorney, Agent, or Firm*—Westerman, Hattori, Daniels & Adrian, LLP

(57) ABSTRACT

An apparatus is arranged to successively make plastic bags. The apparatus comprises a trapezoidal plate including a short edge having opposite ends from which opposite oblique edges extend divergently. The trapezoidal plate comprises a double walled structure in which clearance means is formed between walls. The apparatus further comprises drive means by which the trapezoidal plate is moved in a direction of height of trapezoid so that the short edge can be engaged with the bottom gusset material. In addition, the apparatus comprises a pair of folding plates arranged to be engaged with the bottom gusset material and then inserted into the clearance means at positions corresponding to the oblique edges in accordance with the movement of the trapezoidal plate so that the bottom gusset material can be inserted into the clearance means by the folding plates to be folded into halves along the short edge and folded into the clearance means along the oblique edges. The bottom gusset material is then inserted between the pair of panel portions.

9 Claims, 10 Drawing Sheets

(A)

(B)

PLASTIC BAG MAKING APPARATUS

FIELD OF THE INVENTION

The invention relates to an apparatus for successively making plastic bags.

PRIOR ART

There has been proposed an apparatus for successively making plastic bags each of which comprises a pair of panel portions, first and second side gusset portions and a bottom gusset portion, as disclosed in U.S. Patent Application Publication No. US-2001-0002938-A1. The pair of panel portions are superposed with each other to define aligned top edges, first and second side edges and bottom edges. The first side gusset portion is disposed between the first side edges to extend therealong. The second side gusset portion is disposed between the second side edges to extend therealong. Each of the side gusset portions is folded into halves along a centerline extending longitudinally thereof, to be superposed into two layers and interposed between the pair of panel portions. The first side edges are connected with each other by means of the first side gusset portion, the second side edges being connected with each other by means of the second side gusset portion.

On the other hand, the bottom gusset portion is disposed between the bottom edges to extend therealong. The bottom gusset portion is also folded into halves along a centerline extending longitudinally thereof, to be superposed into two layers and interposed between the pair of panel portions. The bottom edges are connected with each other by means of the bottom gusset portion. In addition, the bottom gusset portion has first and second ends at which first and second auxiliary gusset portions are formed. Each of the auxiliary gusset portions is folded from the bottom gusset portion along folded lines extending at an angle of about 45° with respect to the centerline of bottom gusset portion. The first auxiliary gusset portion is further folded into halves along a centerline which is an extension of the centerline of bottom gusset portion, to be superposed into two layers one of which is interposed along with one of the layers of bottom gusset portion between one of the panel portions and one of the layers of first side gusset portion. The other layer of first auxiliary gusset portion is interposed along with the other layer of bottom gusset portion between the other panel portion and the other layer of first side gusset portion. The first side gusset portion is connected with the bottom gusset portion by means of the first auxiliary gusset portion. The second auxiliary gusset portion is further folded into halves along a centerline which is an extension of the centerline of bottom gusset portion, to be superposed into two layers one of which is interposed along with one of the layers of bottom gusset portion between one of the panel portions and one of the layers of second side gusset portion. The other layer of second auxiliary gusset portion is interposed along with the other layer of bottom gusset portion between the other panel portion and the other layer of second side gusset portion. The second side gusset portion is connected with the bottom gusset portion by means of the second auxiliary gusset portion.

Accordingly, the plastic bag is advantageous in that the first and second side gusset portions can be unfolded between the first and second side edges respectively to obtain a large capacity. The bottom gusset portion and the first and second auxiliary gusset portions can be unfolded between the bottom edges to constitute a rectangular bottom. The plastic bag can therefore stably stand on a table.

In order to make such the plastic bags in the apparatus, a main or panel material is fed longitudinally thereof and intermittently for a length. The panel material includes a pair of panel portions superposed with each other to define aligned first and second side edges. The panel material further includes a first side gusset portion disposed between and extending along the first side edges and a second side gusset portion disposed between and extending along the second side edges.

In addition, one of the panel portions is cut as well as the first and second side gusset portions widthwise of the panel material so that an opening can be formed in the panel material whenever the panel material is fed intermittently. An additional or bottom gusset material is then inserted between the pair of panel portions through the opening whenever the panel material is fed intermittently. Furthermore, the bottom gusset material is guided by guide means to be folded into a predetermined shape when being inserted between the pair of panel portions so that the bottom gusset portion and the first and second auxiliary gusset portion can be formed out of the bottom gusset material. The bottom gusset portion is folded into halves. The first and second auxiliary gusset portions are folded from the bottom gusset portion and folded into halves.

Furthermore, the apparatus includes folded tendency means for making the bottom gusset material having a tendency to be folded before being inserted between the pair of panel portions. For example, the folded tendency means comprises a heater for heating and pressurizing the bottom gusset material to make it having a tendency to be folded. The bottom gusset material is then guided by the guide means to be folded. Accordingly, the bottom gusset material can be conveniently folded into the predetermined shape and then inserted between the panel portions.

The panel material and the bottom gusset material are then fed intermittently by means of the other panel portion and heat sealed with each other by heat seal means. In addition, a cutter cuts the panel material to make the plastic bag.

However, the apparatus involves the folded tendency means to be high in cost. In addition, the bottom gusset material comprises a laminated plastic film including a sealant which is laminated on a base material. The sealant may therefore be damaged when making the bottom gusset material having the tendency to be folded, spoiling property of gas barrier and resulting in pin holes.

It is therefore an object of the invention to provide a new and improved apparatus for successively making plastic bags, to thereby overcome the above problems.

Other object of the invention is to provide the apparatus in which a panel material is fed longitudinally thereof and intermittently for a length. The panel material includes a pair of panel portions superposed with each other to define aligned first and second side edges. The panel material further includes a first side gusset portion disposed between and extending along the first side edges and a second side gusset portion disposed between and extending along the second side edges. One of the panel portions is cut as well as the first and second side gusset portions widthwise of the panel material so that an opening can be formed in the panel material whenever the panel material is fed intermittently. A bottom gusset material is then inserted between the pair of panel portions through the opening whenever the panel material is fed intermittently.

Other object of the invention is to provide the apparatus in which the bottom gusset material can be conveniently folded into a predetermined shape and then inserted between the panel portions, without making the bottom gusset material having a tendency to be folded.

SUMMARY OF THE INVENTION

According to the invention, the apparatus comprises a trapezoidal plate including a short edge having opposite ends from which opposite oblique edges extend divergently. The trapezoidal plate comprises a double walled structure in which clearance means is formed between walls.

The apparatus further comprises drive means by which the trapezoidal plate is moved in a direction of height of trapezoid so that the short edge can be engaged with the bottom gusset material.

In addition, the apparatus comprises a pair of folding plates arranged to be engaged with the bottom gusset material and then inserted into the clearance means at positions corresponding to the oblique edges in accordance with the movement of the trapezoidal plate so that the bottom gusset material can be inserted into the clearance means by the folding plates to be folded into halves along the short edge and folded into the clearance means along the oblique edges. The bottom gusset material is then inserted between the pair of panel portions.

In other embodiment, the apparatus comprises a triangular plate including an apex portion from which opposite oblique edges extend divergently. The triangular plate comprises a double walled structure in which clearance means is formed between walls.

The apparatus further comprises drive means by which the triangular plate is moved in a direction of height of triangle so that the apex portion can be engaged with the bottom gusset material.

In addition, the apparatus comprises a pair of folding plates arranged to be engaged with the bottom gusset material and then inserted into the clearance means at positions corresponding to the oblique edges in accordance with the movement of the triangular plate so that the bottom gusset material can be inserted into the clearance means by the folding plates to be folded into halves at the apex portion and folded into the clearance means along the oblique edges. The bottom gusset material is then inserted between the pair of panel portions.

DETAILED DESCRIPTION OF THE PREFERRED EMBODIMENT

Figure 1:
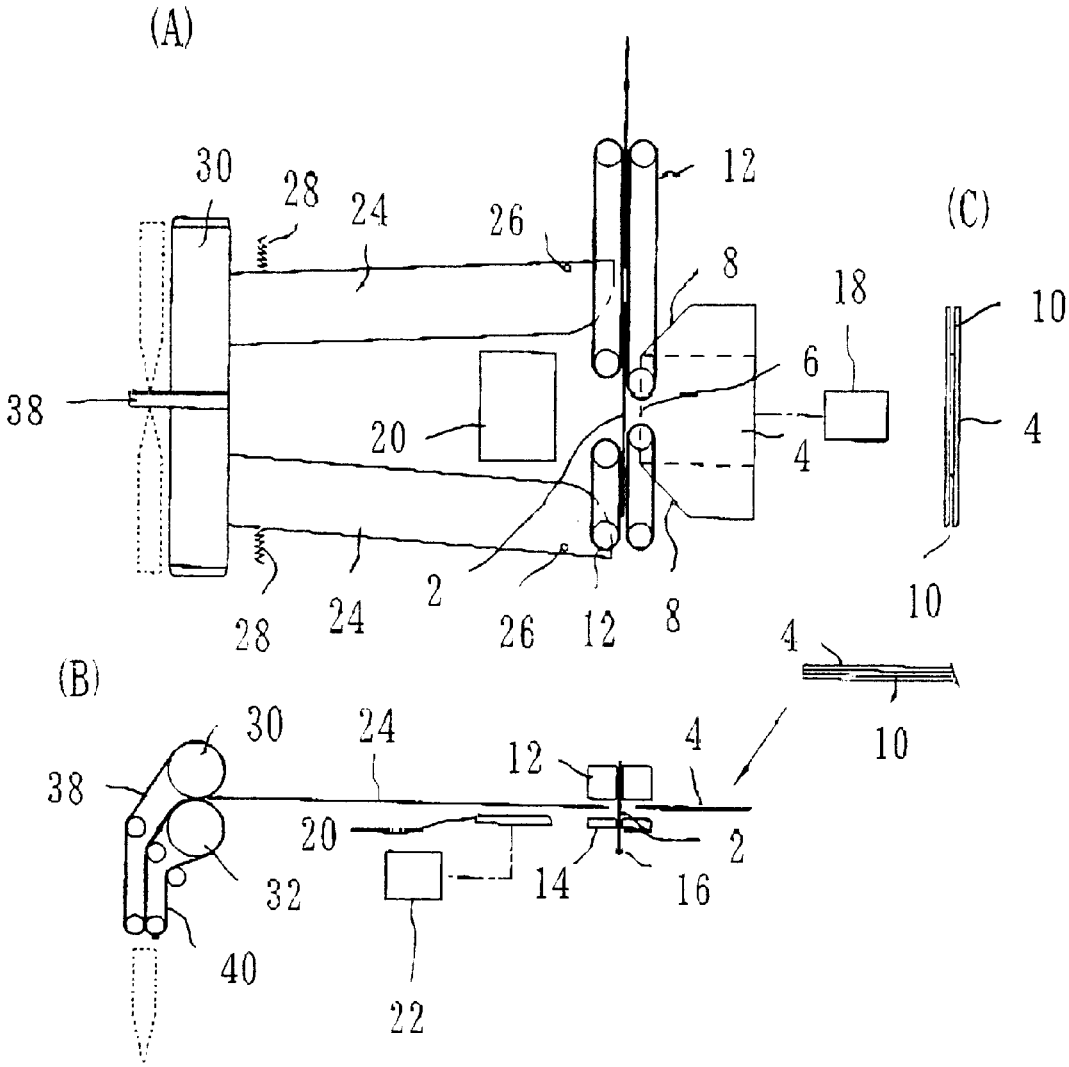
FIG. 1 contains a plan view (A), a side view (B) and an elevational view (C) illustrating a trapezoidal plate and folding plates in an apparatus for successively making plastic bags according to the invention.

Referring now to the drawings, FIG. 1 illustrates an apparatus for successively making plastic bags according to the invention. A bottom gusset material 2 is used to make the plastic bag.

The apparatus comprises a trapezoidal plate 4 including a short edge 6 having opposite ends from which opposite oblique edges 8 extend divergently. The trapezoidal plate 4 comprises a double walled structure in which clearance means 10 is formed between walls. In the embodiment, the trapezoidal plate 4 includes a spacer interposed between two plates which are opposed to each other. The clearance means comprises clearances 10 formed between the plates or walls to extend in a direction of height of trapezoid at positions corresponding to the oblique edges 8.

The apparatus further includes a conveyor by which the bottom gusset material 2 is fed intermittently one by one. The conveyor comprises upper and lower portions each of which includes two pairs of endless belts 12 and 14 extending horizontally. The trapezoidal plate 4 is disposed horizontally to be interposed between the upper and lower endless belts 12 and 14. The bottom gusset material 2 is sandwiched between the pairs of endless belts 12 and 14 to extend horizontally and stand upright on a guide rail 16. The bottom gusset material 2 is then fed intermittently along the guide rail 16 by the pairs of endless belts 12 and 14 to reach a position in which the trapezoidal plate 4 is opposed to the bottom gusset material 2.

Figure 2:
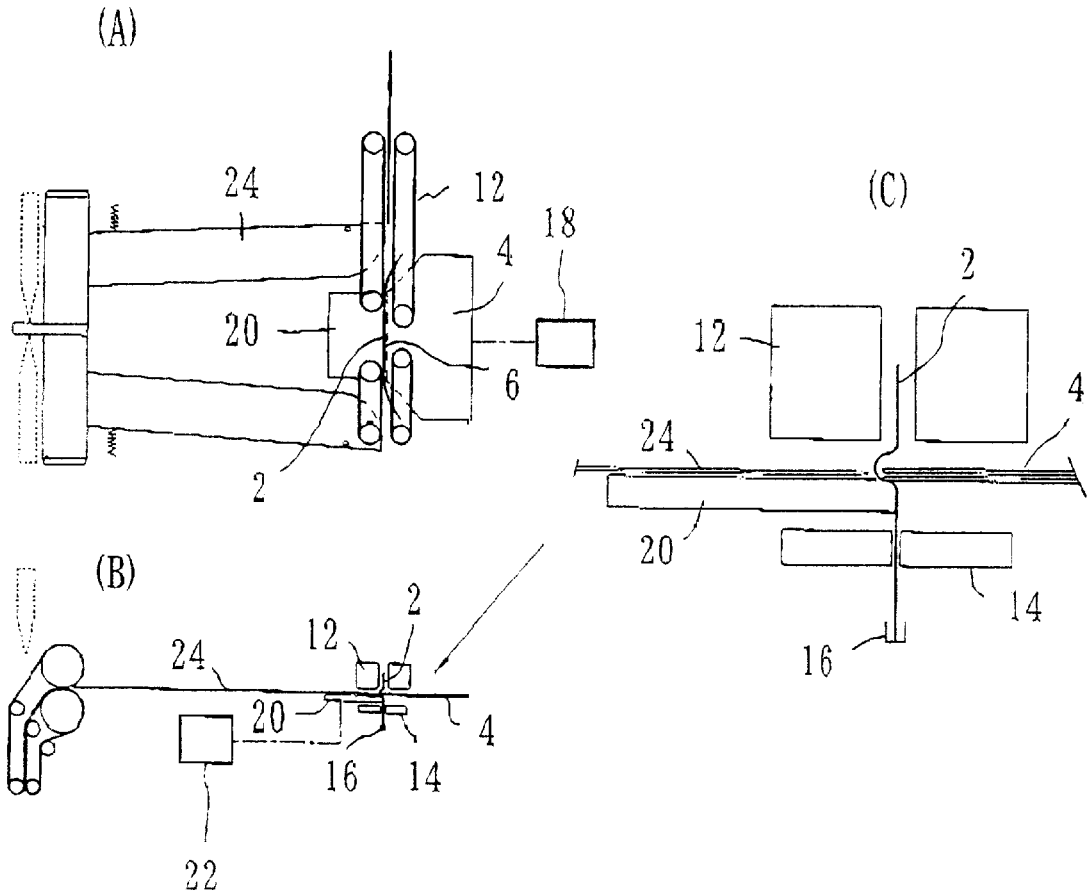
FIG. 2 contains a plan view (A), a side view (B) and an enlarged view (C) of a step next to that of FIG. 1.
Figure 3:
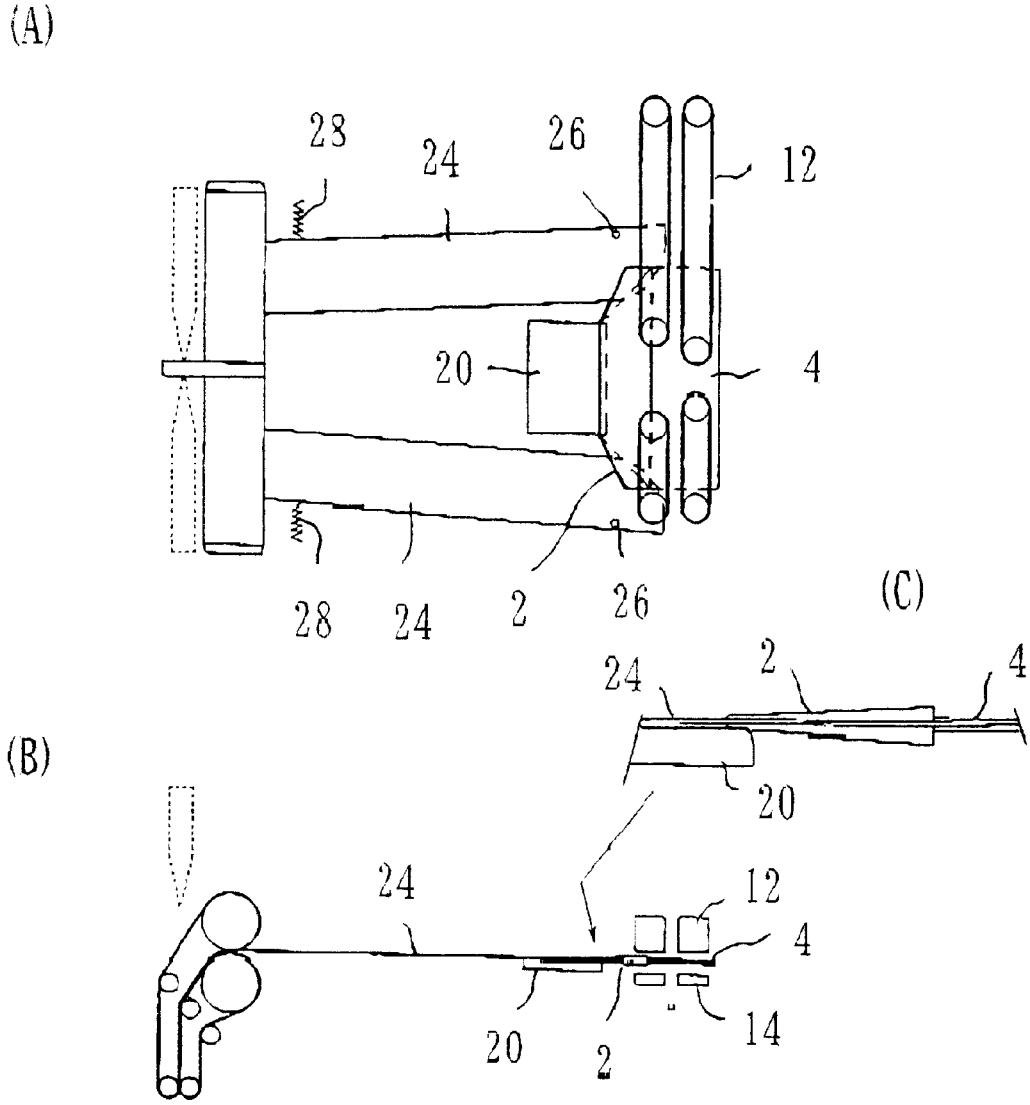
FIG. 3 contains a plan view (A), a side view (B) and an enlarged view (C) of a step next to that of FIG. 2.

The apparatus further includes drive means such as an air cylinder 18 by which the trapezoidal plate 4 is moved in the direction of height of trapezoid so that the short edge 6 can be engaged with the bottom gusset material 2, as shown in FIG. 2. In the embodiment, a board 20 is disposed horizontally and moved by drive means such as a cylinder 22 to be advanced toward the bottom russet material 2 and the trapezoidal plate 4 and interposed between the upper and lower endless belts 12 and 14. The bottom gusset material 2 is then released from the upper endless belts 12, which are opened by drive means, simultaneously with or before the engagement of the short edge 6 with the bottom gusset material 2 so that the bottom gusset material 2 can be sandwiched between the trapezoidal plate 4 and the board 20. In addition, the bottom gusset material 2 is released from the lower endless belts 14, which are opened by drive means. The trapezoidal plate 4 is further moved by the drive means 18 to be advanced in the direction of height of trapezoid along with the board 20 which is moved by the drive means 22, so that the bottom gusset material 2 can be drawn and moved by the trapezoidal plate 4 and the board 20, as shown in FIG. 3.

Figure 4:
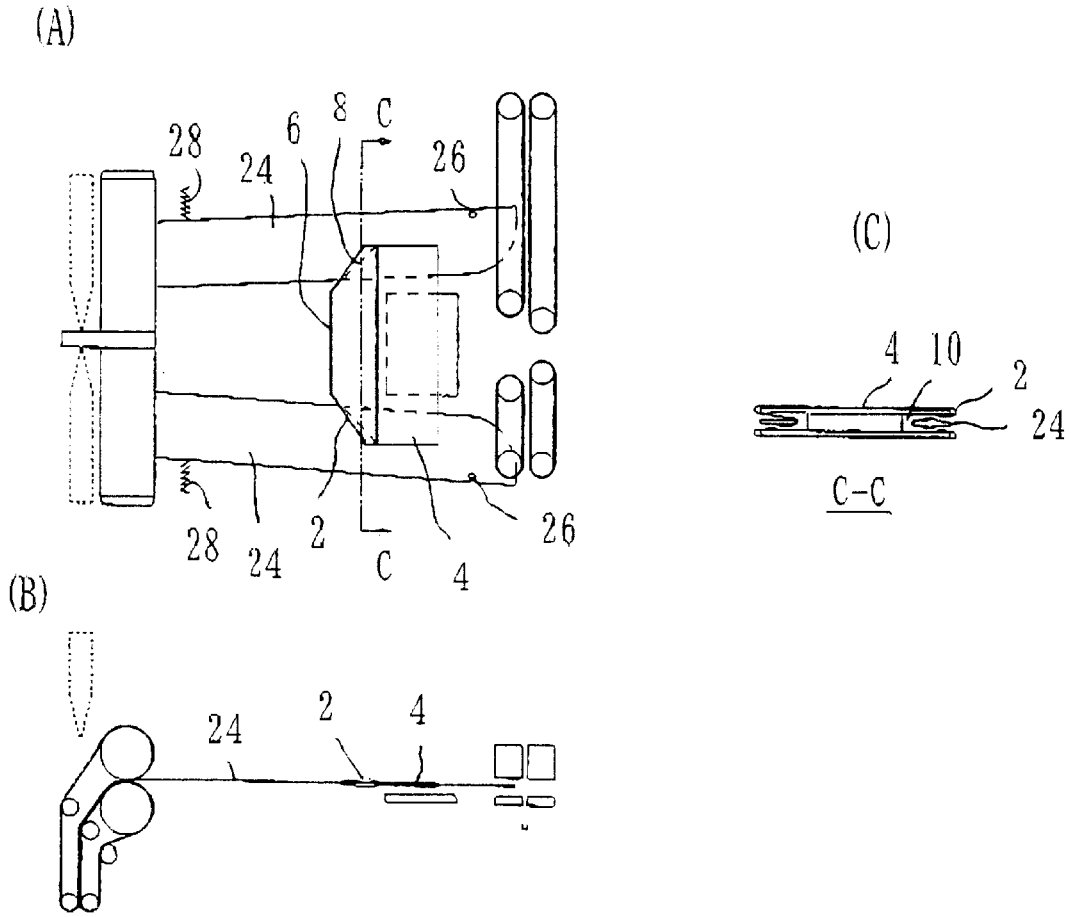
FIG. 4 contains a plan view (A) and a side view (B) of a step next to that of FIG. 3 and a sectional view (C) taken along a line C—C.

The apparatus further includes a pair of folding plates 24 disposed horizontally and interposed between the upper and lower endless belts 12 and 14. The pair of folding plates 24 are arranged to be engaged with the bottom gusset material 2 and then inserted into the clearance means 10 at positions corresponding to the oblique edges 8 in accordance with the movement of the trapezoidal plate 4. The bottom gusset material 2 is then released from the board 20 which is stopped and lowered by the drive means 22. The bottom gusset material 2 is therefore inserted into the clearance means 10 by the folding plates 24 to be folded into halves along the short edge 6 and folded into the clearance means 10 along the oblique edges 8, as shown in FIG. 4.

Figure 5:
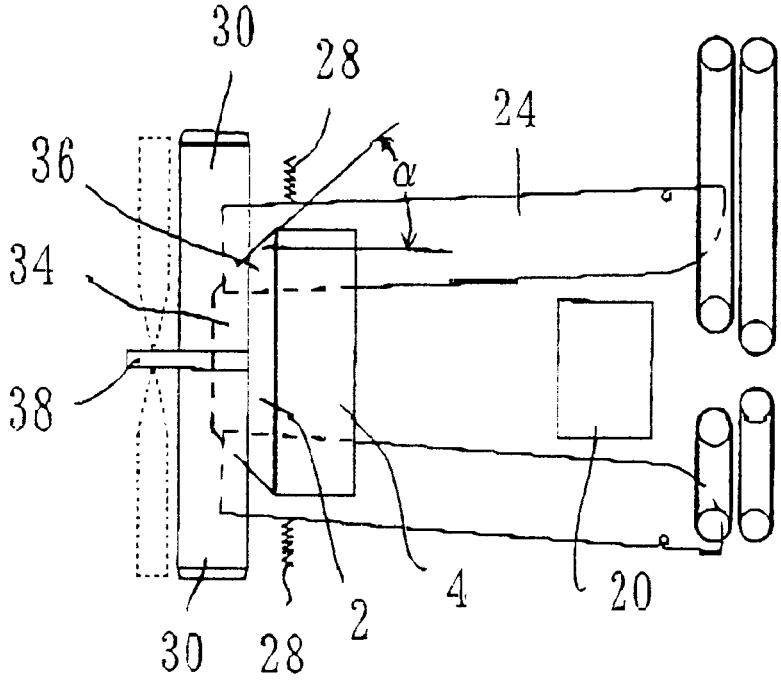
FIG. 5 contains a plan view (A) and a side view (B) of a step next to that of FIG. 4.
Figure 5:
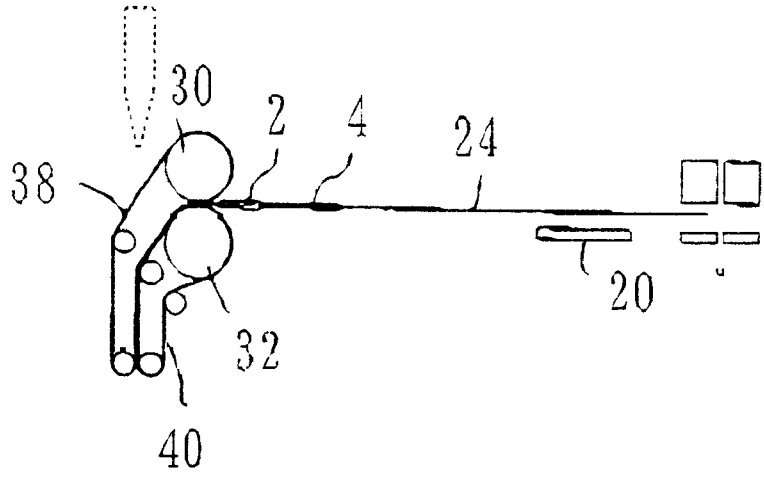

The folding plates 24 are supported by pins 26 to extend in the direction of movement of trapezoidal plate 4. In addition, the folding plates 24 are resiliently urged by spring means 28 to be moved about the pins 26, inclined inward in the direction of movement of trapezoidal plate 4 and pressed against the bottom gusset material 2 in the clearance means 10 so that the bottom gusset material 2 can be folded completely, as shown in FIG. 5. The oblique edges 8 extend at an angle $\alpha$ slightly larger than 45° with respect to the direction of movement of the trapezoidal plate 4. The bottom gusset material 2 is therefore folded at the angle $\alpha$ slightly larger than 45° to be kept strained. In the embodiment, the angle $\alpha$ is 47°.

The bottom gusset material 2 is sandwiched between and pulled by upper and lower rollers 30 and 32 rotated by drive means when the trapezoidal plate 4 reaches the position of FIG. 5. The bottom gusset material 2 is therefore moved by the upper and lower rollers 30 and 32 to be discharged from the trapezoidal plate 4. The folding plates 24 are pressed against the bottom gusset material 2 which are moved by the upper and lower rollers 30 and 32. The bottom gusset material 2 is then compressed between the upper and lower rollers 30 and 32 to be folded at an angle of about 45°.

Figure 10:
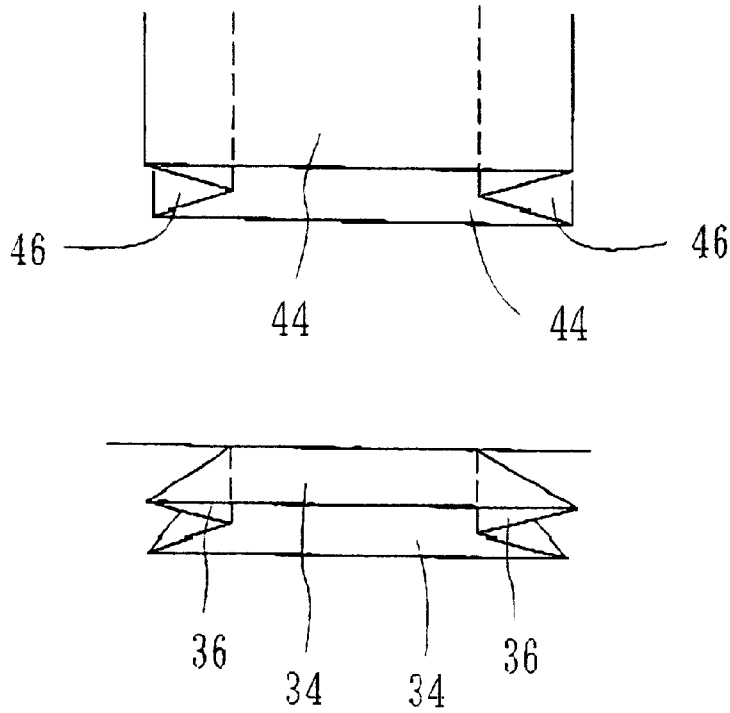
FIG. 10 is a perspective view of the plastic bag of FIG. 9 with the bottom gusset portion removed.

Accordingly, the bottom gusset material 2 is folded into a predetermined shape so that a bottom gusset portion 34 and first and second auxiliary gusset portions 36 can be formed out of the bottom gusset material 2, as shown in FIG. 10. The bottom gusset portion 34 is folded into halves along a centerline extending longitudinally thereof, to be superposed into two layers. Each of the auxiliary gusset portions 36 is folded from the bottom gusset portion 34 along folded lines extending at an angle of about 45° with respect to the centerline of bottom gusset portion 34. Each of the auxiliary gusset portions 36 is further folded into halves along a centerline which is an extension of the centerline of bottom gusset portion 34, to be superposed into two layers. The trapezoidal plate 4 and the board 20 are then moved by the drive means 18 and 22 to be returned to the original positions for next folding step of bottom gusset material.

Figure 6:
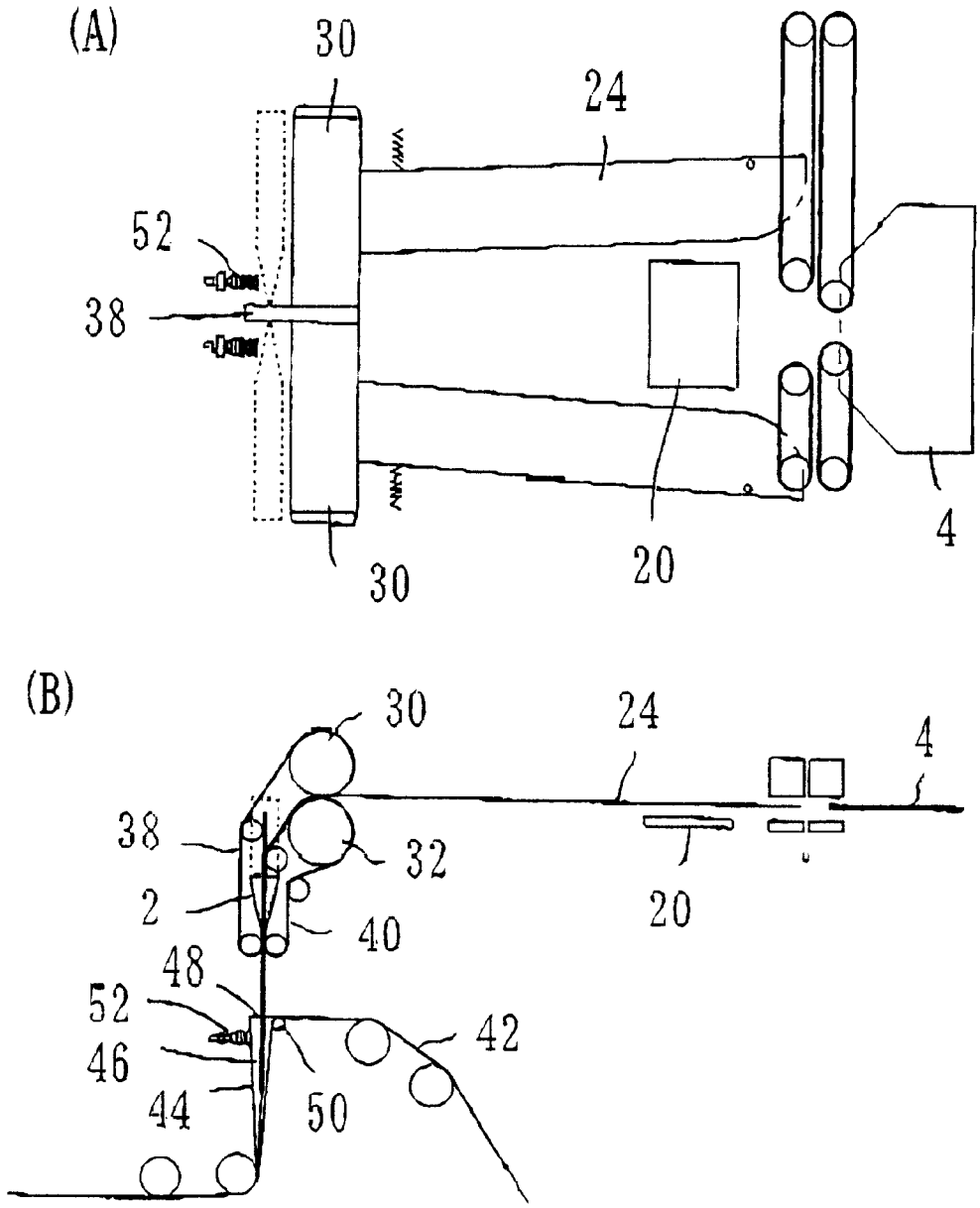
FIG. 6 contains a plan view (A) and a side view (E) of a step next to that of FIG. 5.

In addition, the bottom gusset material 2 is sandwiched between a pair of endless belts 38 and 40 having narrow widths and disposed centrally of bottom gusset material 2. The bottom gusset material 2 is therefore held, moved and stopped by the pair of endless belts 38 and 40 driven by drive means, after passing through the upper and lower rollers 30 and 32, as shown in FIG. 6. The pair of endless belts 38 and 40 are bent downward so that the bottom gusset material 2 can be kept downward to stand by.

In order to make the plastic bags in the apparatus, a panel material 42 is fed longitudinally thereof and intermittently for a length, as in the case of the apparatus of U.S. Patent Application Publication No. US-2001-0002938-A1. The panel material 42 includes a pair of panel portions 44 superposed with each other to define first and second side edges. The panel material 42 further includes a first and second side gusset portions 46 each of which is disposed between the first or second side gusset edges to be extend therealong.

In addition, one of the panel portions 44 is cut as well as the first and second gusset portions 46 widthwise of the panel material 42 so that an opening 48 can be formed in the panel material 42 whenever the panel material 42 is fed intermittently, as disclosed in the U.S. Patent Application Publication. The opening 48 reaches a position of guide roller 50 whenever the panel material 42 is fed intermittently. The panel material 42 is therefore bent by the guide roller 50 so that the opening 48 can be opened by bending. The opening 48 may be opened by a suction pad 52 which suctionally attracts one of the layers of panel portion 44. The bottom gusset material 2 is then inserted between the pair of panel portions 44 through the opening 48 whenever the panel material 42 is fed intermittently.

Figure 7:
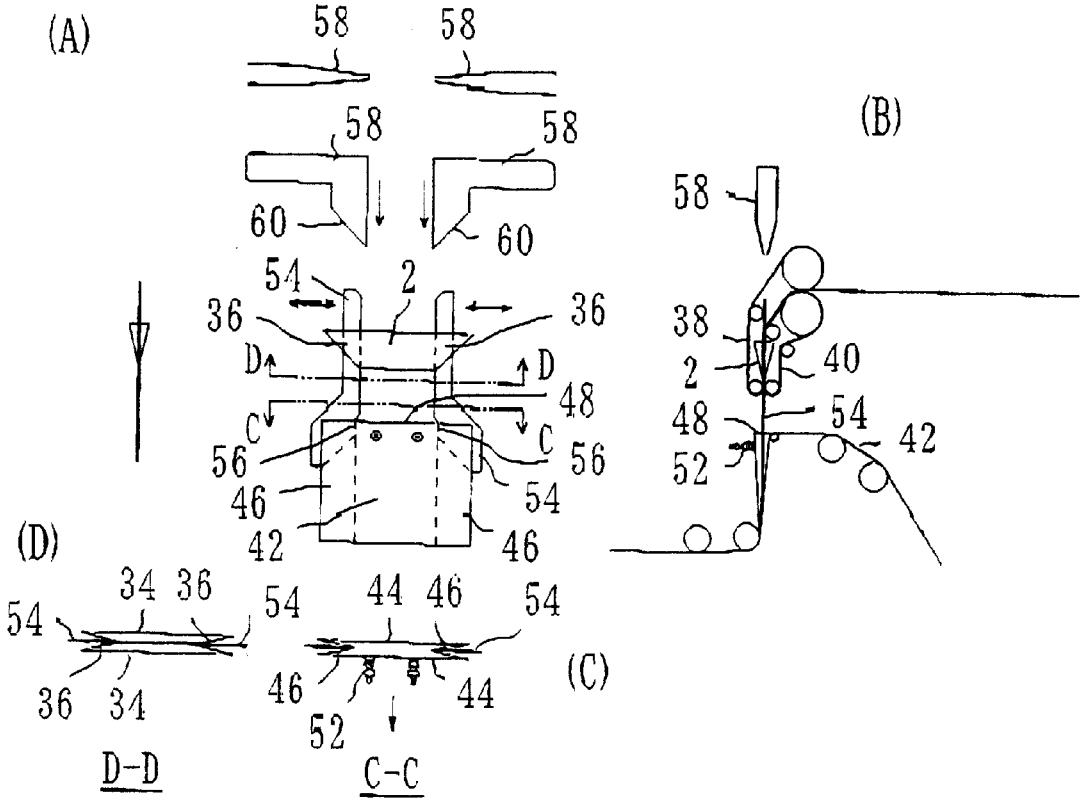
FIG. 7 contains an explanatory view (A) and a side view (B) illustrating inserting means in the apparatus, a sectional view (C) taken along a line C—C and a sectional view (D) taken along a line D—D.

In the embodiment, the bottom gusset material 2 is held by the pair of endless belts 38 and 40 and kept downward to stand by after being folded, as described above. In this connection, the opening 48 is disposed and opened upward under the bottom gusset material 2. A pair of guide plates 54 are then moved horizontally on the opposite sides of the bottom gusset material 2 and panel material 42 and advanced toward the bottom gusset material 2 and panel material 42 to be inserted between the layers of auxiliary gusset portions 36 and side gusset portions 46, as shown in FIG. 7. The pair of guide plates 54 are disposed near to or engaged with the folded lines of auxiliary gusset portions 36 and side gusset portions 46. As to the distance between the folded lines along which the first and second side gusset portions 46 are folded, it is slightly larger than the distance between the folded lines along which the first and second auxiliary gusset portions 36 are folded by reason that the opening 48 is opened by the suction pad 52. The pair of guide plates 54 are therefore spaced at a distance which is enlarged by notches 56 formed therein, to be inserted between the layers of side gusset portions 46 and disposed near to or engaged with the folded lines thereof.

Furthermore, two pairs of fingers 58 are then moved downward along the guide plates 54 on the opposite sides thereof to be inserted into the bottom gusset material 2. The pairs of fingers 58 are disposed between the layers of bottom gusset portion 34 and auxiliary gusset portions 36 respectively. The bottom gusset material 2 is folded at an angle of about 45° as described above. In this connection, the fingers 58 include oblique edges 60 extending at an angle of about 45° to be engaged with the folded lines of bottom gusset material 2. The bottom gusset material 2 is therefore pushed downward by the fingers 58 to be moved downward along the guide plates 54 and discharged from the endless belts 38 and 40. The endless belts 38 and 40 may be opened by drive means so that the bottom gusset material 2 can be released from the endless belts 38 and 40 when being discharged from the endless belts 38 and 40.

Figure 8:
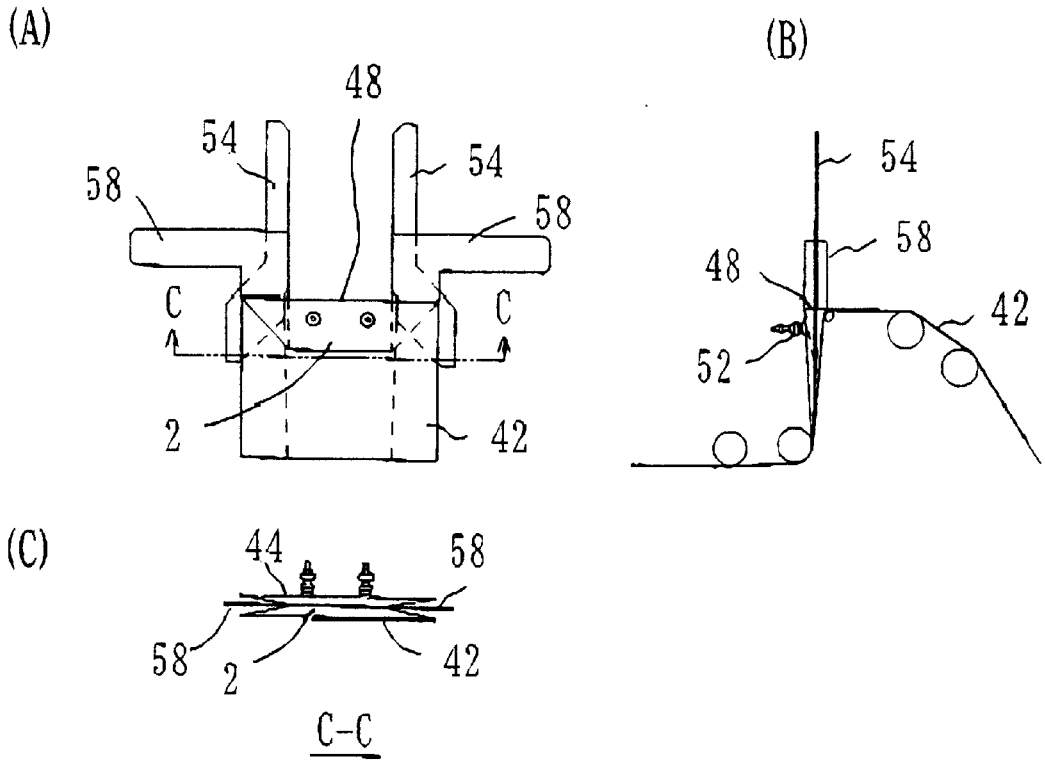
FIG. 8 contains an explanatory view (A) and a side view (B) of a step next to that of FIG. 7 and a sectional view (C) taken along a line C—C.

It should therefore be understood in the apparatus that the pairs of fingers 58 cooperate with the pair of guide plates 54 to make the bottom gusset material 2 inserted between the pair of panel portions 44 through the opening 48 in the panel material 42, as shown in FIG. 8. As to the layers of first and second bottom gusset portions 34 and first and second auxiliary gusset portions 36 formed out of the bottom gusset material 2, one of the layers of first auxiliary gusset portion 36 is interposed along with one of the layers of bottom gusset portion 34 between one of the panel portions 44 and one of the layers of first side gusset portion 46. The other layer of first auxiliary gusset portion 36 is interposed along with the other layer of bottom, gusset portion 34 between the other panel portion 44 and the other layer of first side gusset portion 46. One of the layers of second auxiliary gusset portion 36 is interposed along with the one of the layers of bottom gusset portion 34 between one of the panel portions 44 and one of the layers of second side gusset portion 46. The other layer of second auxiliary gusset portion 36 is interposed along with the other layer of bottom gusset portion 34 between the other panel portion 44 and the other layer of second side gusset portion 46. The fingers 58 are then moved upward to be drawn out of the bottom gusset material 2 and returned to the original positions. The guide plates 54 are also returned to the original positions.

Figure 9:
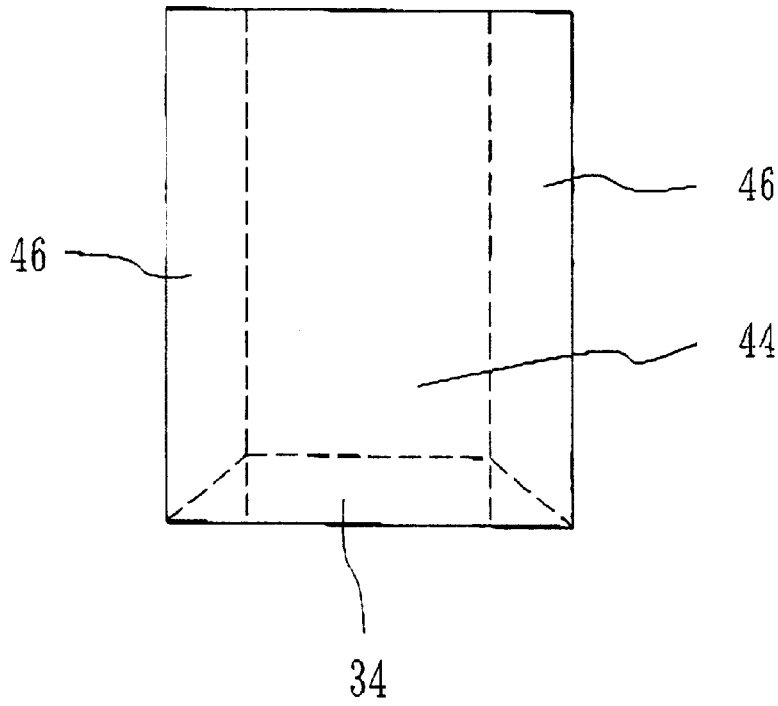
FIG. 9 is an elevational view of a plastic bag to be made by the apparatus of FIG. 1.
Figure 11:
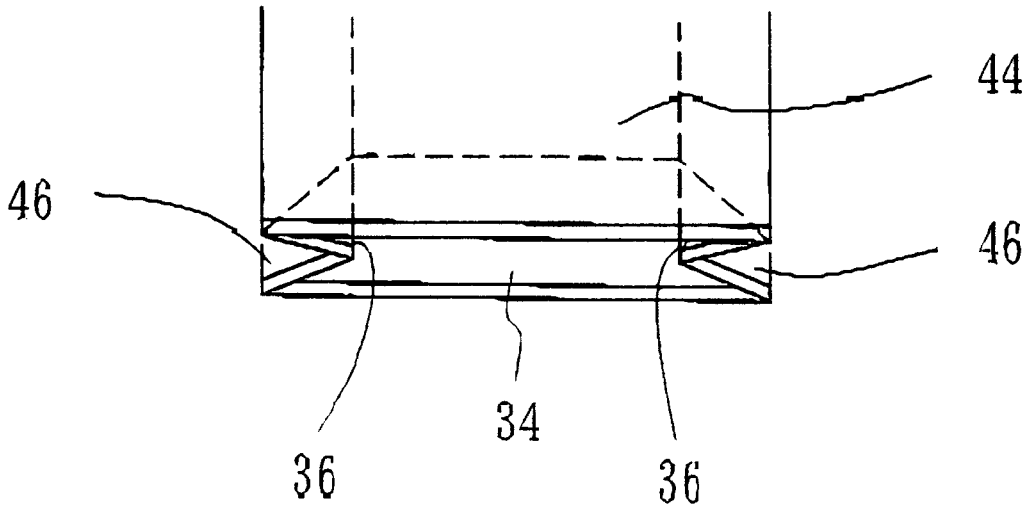
FIG. 11 is a perspective view of the plastic bag of FIG. 10 with the bottom gusset portion incorporated.

The panel material 42 and the bottom gusset material 2 are then fed intermittently by means of the other panel portion 44 and heat sealed by heat seal means, as in the case of the apparatus of the U.S. Patent Application Publication. In addition, a cutter cuts the panel material 42 to make the plastic bag, as shown in FIG. 9 and FIG. 11.

In the embodiment, the apparatus includes the trapezoidal plate 4 by which the bottom gusset material 2 is folded, as described above. The bottom gusset portion 34 is therefore formed out of the bottom gusset material 2 to be shaped into a trapezoid. Accordingly, in the plastic bag, the bottom gusset portion 34 and the auxiliary gusset portions 36 are unfolded between the bottom edges to constitute an oblong bottom.

Figure 12:
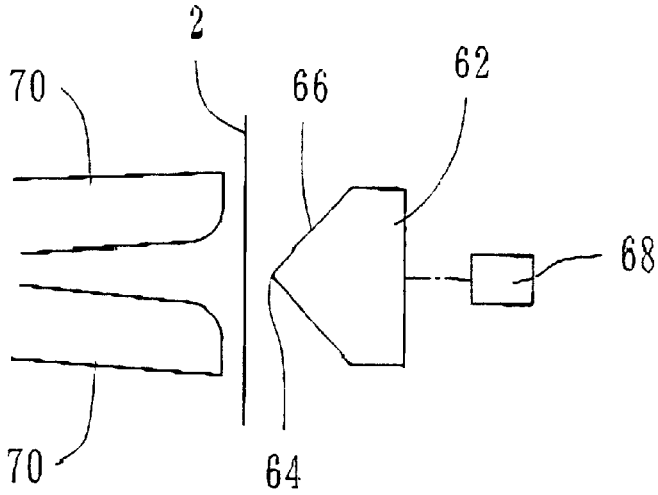
FIG. 12 is an explanatory view of other embodiment.

In other embodiment shown in FIG. 12, the apparatus comprises a triangular plate 62 including an apex portion 64 from which opposite oblique edges 66 extend divergently. The triangular plate 62 comprises a double walled structure in which clearance means is formed between walls, as in the case of the trapezoidal plate 4.

The apparatus further includes drive means 68 by which the triangular plate 62 is moved in a direction of height of triangle so that the apex portion 64 can be engaged with the bottom gusset material 2. In addition the apparatus includes a pair of folding plates 70 arranged to be engaged with the bottom gusset material 2 and then inserted into the clearance means at positions corresponding to the oblique edges 66 in accordance with the movement of the triangular plate 62 so that the bottom gusset material 2 can be inserted into the clearance means by the folding plates 70 to be folded into halves at the apex portion 64 and folded into the clearance means along the oblique edges 66. The bottom gusset material 2 is then inserted between the pair of panel portions 44.

The bottom gusset portion is therefore formed out of the bottom gusset material 2 to be shaped into a triangle. Accordingly, in the plastic bag, the bottom gusset portion and the auxiliary gusset portions are unfolded between the bottom edges to constitute a square bottom.

Accordingly, the apparatus is advantageous in that the bottom gusset material 2 can be conveniently folded into the predetermined shape and then inserted between the pair of panel portions 44, without making the bottom gusset material 2 having a tendency to be folded. The apparatus is therefore required to involve no folded tendency means for making the bottom gusset material 2 having the tendency to be folded, to be low in cost. A sealant is kept from being damaged in a laminated plastic film used as the bottom gusset material 2, not spoiling property of gas barrier and not resulting in pin holes.

What is claimed is:

1. An apparatus for successively making plastic bags, in which a panel material is fed longitudinally thereof and intermittently for a length, said panel material including a pair of panel portions superposed with each other to define aligned first and second side edges, said panel material further including a first side gusset portion disposed between and extending along said first side edges and a second side gusset portion disposed between and extending along said second side edges, one of said panel portions being cut as well as said first and second side gusset portions widthwise of said panel material so that an opening can be formed in said panel material whenever said panel material is fed intermittently, a bottom gusset material being then inserted between said pair of panel portions through said opening whenever said panel material is fed intermittently, said apparatus comprising:

a trapezoidal plate including a short edge having opposite ends from which opposite oblique edges extend divergently, said trapezoidal plate comprising a double walled structure in which clearance means is formed between walls;

drive means by which said trapezoidal plate is moved in a direction of height of trapezoid so that said short edge can be engaged with said bottom gusset material; and a pair of folding plates arranged to be engaged with said bottom gusset material and then inserted into said clearance means at positions corresponding to said oblique edges in accordance with the movement of said trapezoidal plate so that said bottom gusset material can be inserted into said clearance means by said folding plates to be folded into halves along said short edge and folded into said clearance means along said oblique edges, said bottom gusset material being then inserted between said pair of panel portions.

2. The apparatus as set forth in claim 1 wherein said trapezoidal plate includes a spacer interposed between two plates which are opposed to each other, said clearance means comprising clearances formed between said plates to extend in said direction of height of trapezoid at positions corresponding to said oblique edges.

3. The apparatus as set forth in claim 1 further comprising a conveyor by which said bottom gusset material is fed intermittently one by one to reach a position in which said trapezoidal plate is opposed to said bottom gusset material.

4. The apparatus as set forth in claim 1 wherein said bottom gusset material is sandwiched between and moved by said trapezoidal plate and a board.

5. The apparatus as set forth in claim 1 wherein said folding plates extend in the direction of movement of trapezoidal plate, said folding plates being resiliently urged by spring means to be moved about pins and pressed against said bottom gusset material in said clearance means so that said bottom gusset material can be folded completely.

6. The apparatus as set forth in claim 5 wherein said bottom gusset material is sandwiched between and pulled and moved by upper and lower rollers to be discharged from said trapezoidal plate.

7. The apparatus as set forth in claim 6 wherein said bottom gusset material is sandwiched between and held, moved and stopped by a pair of endless belts after passing through said upper and lower rollers.

8. The apparatus as set forth in claim 7 wherein two pairs of fingers are inserted into said bottom gusset material, said pairs of fingers cooperating with a pair of guide plates to make the bottom gusset material inserted between said pair of panel portions through said opening.

9. An apparatus for successively masking plastic bags, in which a panel material is fed longitudinally thereof and intermittently for a length, said panel material including a pair of panel portions superposed with each other to define aligned first and second side edges, said panel material further including a first side gusset portion disposed between and extending along said first side edges and a second side gusset portion disposed between and extending along said second side edges, one of said panel portions being cut as well as said first and second side gusset portions widthwise of said panel material so that an opening can be formed in said panel material whenever said panel material is fed intermittently, a bottom gusset material being then inserted between said pair of panel portions through said opening whenever said panel material is fed intermittently, said apparatus comprising:

a triangular plate including an apex portion from which opposite oblique edges extend divergently, said triangular plate comprising a double walled structure in which clearance means is formed between walls;

drive means by which said triangular plate is moved in a direction of height of triangle so that said apex portion can be engaged with said bottom gusset material; and a pair of folding plates arranged to be engaged with said bottom gusset material and then inserted into said clearance means at positions corresponding to said oblique edges in accordance with the movement of said triangular plate so that said bottom gusset material can be inserted into said clearance means by said folding plates to be folded into halves at said apex portion and folded into said clearance means along said oblique edges, said bottom gusset material being then inserted between said pair of panel portions.

* * * * *